US006521397B1

(12) United States Patent
Kapiamba et al.

(10) Patent No.: US 6,521,397 B1
(45) Date of Patent: Feb. 18, 2003

(54) PHOTOGRAPHIC ELEMENT CONTAINING AZOLE COUPLERS

(75) Inventors: Mbiya Kapiamba, Macedon, NY (US); Donald R. Diehl, Rochester, NY (US); James L. Edwards, Rochester, NY (US); David G. Lincoln, Webster, NY (US); Gary M. Russo, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/122,284

(22) Filed: Apr. 12, 2002

(51) Int. Cl.[7] ..... G03C 1/46

(52) U.S. Cl. ..... 430/505; 430/543; 430/558; 430/384; 430/385

(58) Field of Search ..... 430/505, 502, 430/503, 543, 558, 384, 385

(56) References Cited

U.S. PATENT DOCUMENTS

| | | | | | |
|---|---|---|---|---|---|
| 4,668,610 | A | * | 5/1987 | Delprato et al. | 430/558 |
| 4,898,812 | A | * | 2/1990 | Aoki et al. | 430/550 |
| 5,457,004 | A | * | 10/1995 | Mooberry et al. | 430/955 |
| 5,578,436 | A | * | 11/1996 | Hara et al. | 430/558 |
| 6,159,674 | A | | 12/2000 | Edwards | |
| 6,180,328 | B1 | | 1/2001 | Edwards et al. | |
| 6,416,941 | B1 | * | 7/2002 | Reed et al. | 430/558 |

FOREIGN PATENT DOCUMENTS

| | | |
|---|---|---|
| EP | 0 825 488 | 2/1998 |

* cited by examiner

*Primary Examiner*—Geraldine Letscher
(74) *Attorney, Agent, or Firm*—Arthur E. Kluegel

(57) ABSTRACT

Disclosed is a photographic element comprising a support bearing a light sensitive silver halide emulsion layer having associated therewith a dye forming coupler having a formula I,

I wherein:

Ballast is a group containing at least 6 aliphatic carbon atoms,

V represents a chain of three or four atoms, which may be substituted, selected from C, N, O and S sufficient to form an aromatic ring fused to the azole ring and n is 0 or 1, provided that if n is 0, Y and Ballast are directly attached to the 5-membered azole ring, W is an electron withdrawing group selected from the group consisting of —CN, —$CONR_1R_2$, —$CO_2R_1$, —$NO_2$, and —$SO_2R_1$ where $R_1$ and $R_2$ are H or substituents;

X is H or a coupling-off group;

Y is H or a substituent;

Z is an atom or group selected from >N—R, —O—, and —S—.

15 Claims, No Drawings

PHOTOGRAPHIC ELEMENT CONTAINING AZOLE COUPLERS

FIELD OF THE INVENTION

This invention relates to a silver halide photographic element containing an azole coupler having a certain formula that forms a dye having an improved absorption maximum and color gamut.

BACKGROUND OF THE INVENTION

In the photographic art, color images are formed by exposure of a silver halide light sensitive element containing organic dye-forming couplers followed by processing in aqueous developer solutions containing an aromatic primary amine color-developing agent. The resultant dyes formed are yellow, magenta and cyan and result in the formation of a color image in the photographic element.

Although described in the open literature as well as patent literature, 2-benzoxazoleacetonitrile derivatives have never been used as couplers for the generation of azamethine dyes in color paper products. In their most common photographic use, they are reacted with aldehydes to generate methine dyes of general formula 2 that were used for density correction and antihalation as describe in the patent GB 96-22424 by P. Merkel et al.

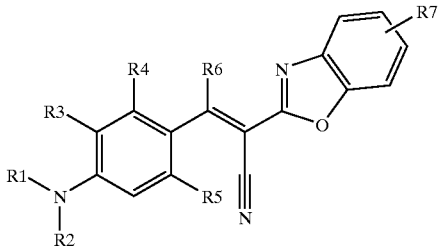

In another application, 2-benzoxazoleacetonitriles are incorporated into a yellow coupler molecule 3 in a color negative film. Upon coupling with the oxidized developer during the photographic processing, the 2-benzoxazoleacetonitrile fragment is released as a yellow methine dye of an absorbance maximum similar to the coupler generated azamethine dye, leading to a higher yield of yellow dye as described by J. B. Mooberry et al. in the patent EP 1016916.

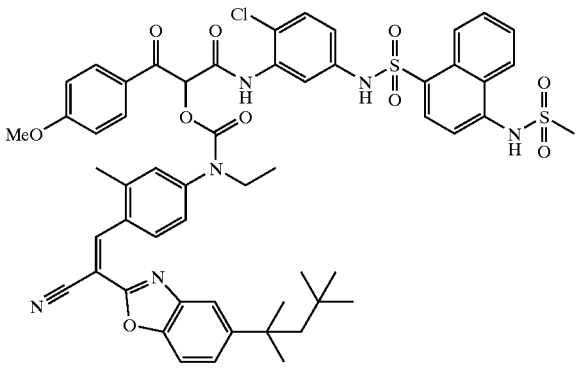

Another application involving 2-benzoxazoleacetonitrile derivatives is their use in coupling reactions with hydrazine derivatives to form azodyes during heat-development as reported by O. Uchida in JP 2000321736.

To our knowledge, there is no record of the 2-benzoxazoleacetonitrile described in this invention being used as azamethine dye-forming couplers by reaction with a color developer in a Color Paper.

In the patent applications number U.S. Pat. No. 6,159,674 and U.S. Pat. No. 6,180,328 B1, James L. Edwards described the invention of an improved photographic element for color imaging in which four or five separately sensitized light-sensitive silver halide emulsions are used. In addition to the three conventional cyan, magenta and yellow dye forming layers, a fourth dye-forming layer comprising a coupler capable of generating a "red" dye that has a hue angle in the range of 355° and 75° and a fifth dye-forming layer comprising a coupler capable of generating a "blue" dye that has a hue angle in the range of 225 and 310°, which increased the gamut of colors possible.

Color gamut is an important feature of color printing and imaging systems. It is a measure of the range of colors that can be produced using a given combination of colorants. It is desirable for the color gamut to be as large as possible. The color gamut of the imaging system is controlled primarily by the absorption characteristics of the set of colorants used to produce the image. Silver halide imaging systems typically employ three colorants, including cyan, magenta, and yellow dyes in the conventional subtractive imaging system The ability to produce an image containing any particular color is limited by the color gamut of the system and materials used to produce the image. Thus, the range of colors available for image reproduction is limited by the color gamut that the system and materials can produce.

Color gamut is often thought to be maximized by the use of so-called "block dyes". In *The Reproduction of Colour* 4th ed., R. W. G. Hunt, pp 135–144, it has been suggested that the optimum gamut could be obtained with a subtractive three-color system using three theoretical block dyes where the blocks are separated at approximately 490 nm and 580 nm. This proposal is interesting but cannot be implemented for various reasons. In particular, there are no real organic based couplers that produce dyes corresponding to the proposed block dyes.

Variations in the block dye concept are advanced by Clarkson, M., E., and Vickerstaff, T., in "Brightness and Hue of Present-Day Dyes in Relation to Colour Photography," Photo. J. 88b, 26 (1948). Three example spectral shapes are given by Clarkson and Vickerstaff: Block, Trapezoidal, and Triangular. The authors conclude, contrary to the teachings of Hunt, that trapezoidal absorption spectra may be preferred to a vertical sided block dye. Again, dyes having these trapezoidal spectra shapes are theoretical and are not available in practice.

Both commercially available dyes and theoretical dyes were investigated in "The Color Gamut Obtainable by the Combination of Subtractive Color Dyes. Optimum Absorption Bands as Defined by Nonlinear Optimization Technique," J. Imaging Science, 30, 9–12. The author, N. Ohta, deals with the subject of real colorants and notes that the existing curve for a typical cyan dye, as shown in the publication, is the optimum absorption curve for cyan dyes from a gamut standpoint.

McInerney, et al, in U.S. Pat. Nos. 5,679,139; 5,679,140; 5,679,141; and 5,679,142 teach the shape of preferred subtractive dye absorption shapes for use in four color, C,M,Y,K based ink-jet prints.

McInerney, et al, in EP 0825,488 teach the shape of preferred subtractive cyan dye absorption shape for use in silver halide based color prints.

Kitchin, et al, in U.S. Pat. No. 4,705,745, teach the preparation of a photographic element for preparing half-tone color proofs comprising four separate imaging layers capable of producing cyan, magenta, yellow and black images.

Powers, et al, in U.S. Pat. No. 4,816,378, teach an imaging process for the preparation of color half-tone images that contain cyan, magenta, yellow and, black images. The use of the black dye does little to improve the gamut of color reproduction.

Haraga, et al, in EP 0915374A1, teach a method for improving image clarity by mixing 'invisible' information in the original scene with a color print and reproducing it as an infrared dye, magenta dye or as a mixture of cyan magenta and yellow dyes to achieve improved color tone and realism. The addition of the resulting infrared, magenta or black dye does little to improve the gamut.

In spite of the foregoing teachings relative to color gamut, the coupler sets which have been employed in silver halide color imaging have not provided the range of gamut desired for modern digital imaging; especially for so-called 'spot colors', Pantone® colors, or 'HiFi colors'.

In the patent U.S. Pat. No. 6,159,674, James Edwards also recommends the use of cyanoacetanilides as couplers in a fourth sensitized photographic layer to produce the increase in Color Gamut. The couplers useful in this invention produce a superior dye density as well as a higher speed compared to 2-cyanoacetanilides described by this prior patent. On top of that, embodiments of the invention also produce a paper with a color gamut that is equal or superior to a paper containing the cyanoacetanilide couplers reported by the patent.

It is a problem to be solved to provide an improved coupler set that provides an improved color density in the spectral region of 490 to 520 nm as well as an increase in color gamut to improve the accuracy of color reproduction.

SUMMARY OF THE INVENTION

In accordance with the present invention, there is provided a photographic element comprising a support bearing a light sensitive silver halide emulsion layer having associated therewith a dye forming coupler having formula I,

I

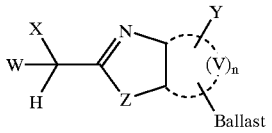

wherein:

Ballast is a group containing at least 6 aliphatic carbon atoms,

V represents a chain of three or four atoms, which may be substituted, selected from C, N, O and S sufficient to form an aromatic ring fused to the azole ring and n is 0 or 1, provided that if n is 0, Y and Ballast are directly attached to the 5-membered azole ring;

W is an electron withdrawing group selected from the group consisting of —CN, —$CONR_1R_2$, —$CO_2R_1$, —$NO_2$, and —$SO_2R_1$ where $R_1$ and $R_2$ are H or substituents, X is H or a coupling-off group;

Y is H or a substituent;

Z is an atom or group selected from >N—R, —O—, and —S—.

Elements employing this coupler exhibit an improved color density in the spectral region of 490 to 520 nm as well as an increase in color gamut to improve the accuracy of color reproduction. They also exhibit improved speed.

DETAILED DESCRIPTION OF THE INVENTION

The couplers useful in the invention are generally as described for formula I above. Usefully, they may be represented by formula II:

II

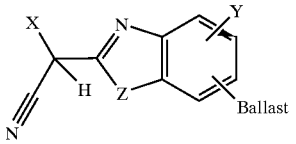

The 2-benzoxazoleacetonitrile dye forming coupler useful in this invention, upon conventional photographic processing provides azarnethine dyes that have desirable spectral absorption characteristics (absorbance maximum at 506–530 nm). Furthermore, addition of a layer comprising a silver halide emulsion containing the coupler of this invention to the conventional color paper with three sensitized emulsions (green, red and blue) give a paper that provides superior speed and color density along with a color gamut that is superior or at least equal to the one provided by cyanoacetanilide couplers.

The couplers useful in the invention are 2-benzoxazoleacetonitrile derivatives that are used as couplers in a fourth sensitized silver imaging layer in photographic applications. The couplers useful in the invention may be prepared from the reaction of appropriate 2-aminophenols and methyl cyanoacetimidate hydrochloride. In a few cases, the ballast group can be directly incorporated in the 2-aminophenol prior to its reaction with methyl cyanoacetimidate hydrochloride.

In most cases, simple, non-ballasted aminophenols are reacted with methyl cyanoacetimidate hydrochloride to produce non-ballasted 2-benzoxazoleacetonitriles. These compounds can carry a nitro or carboxylic group on the phenyl ring. Reduction of the nitro group generates the free amine that can then be ballasted by reaction with carboxylic and sulfonic acid derivatives, while the 2-benzoxazoleacetonitriles substituted by a carboxylic acid can be ballasted by reaction of the acid function with amines, alcohols to produce the ballasted couplers. Preferred couplers of this invention, upon suitable coating in a silver halide photographic material provide, after conventional photographic processing, azamethine dyes with a spectral absorption peak in the region of the spectrum from 510 to 530 nm, corresponding to a CIELAB hue angle of from not less than 355° to not more than 75°.

The couplers of structure I may be represented by couplers bearing a substituted carbon-atom directly bonded to the phenyl back-ring. The substituents on the carbon-atom may be but are not limited to an aliphatic group having preferably 1 to 32 carbon atoms which may be linear, branched or cyclic, and saturated or unsaturated, for example alkyl, aralkyl, alkenyl, alkynyl, cycloalkyl and cycloalkenyl such as methyl, ethyl, propyl, isopropyl, tert-butyl, butyl, sec-butyl, tridecyl, 2-methanesulfonylethyl, 3-(3-pentadecylphenoxy)-propyl, 3-[4-{2-[4-(4-hydroxyphenylsulfonyl)phenoxy]dodecanamide} phenyl]

propyl, 2-ethoxytridecyl, trifluoromethyl, cyclopentyl, 2-(2, 4-di-t-amylphenoxy)propyl and pentadecyl; aryl group, having preferably 6 to 50 atoms, for example phenyl, 4-t-butylphenyl, pentadecylphenyl, 2,4-di-t-amyl-phenyl; heterocyclic groups having preferably 1 to 50 carbon atoms, for example, 2-furyl, 2-thienyl, 2-pyridyl, 2-pyrimidinyl, 3-pyridyl, pyrazolyl, pyrrole, pyrrolidinyl, pyrazolinone, The couplers of structure I may also be represented by compounds bearing an alkoxy substituent, an amino substituent. The alkoxy group having, preferably 1 to 50 carbon atoms, for example, methoxy, ethoxy, propoxy, butoxy, sec-butoxy, 2-methoxyethoxy, 2-dodecyloxyethoxy, and 2-methanesulfonylethoxy; a substituted nitrogen atom directly bonded to the back phenyl ring. The examples of substituents on the nitrogen atom are substituted or unsubstituted alkyl groups, such as alkyl containing 1 to 42, typically 1 to 22 carbon atoms, substituted aryl and heteroaryl groups, substituted acyl groups, substituted sulfonyl groups. Representative substituted alkyls include but are not limited to branched alkyls, cyclic alkyls, arylalkyls, heteroarylalkyls or alkyls substituted with halogens or inert heteroatoms.

Representative aryl groups include an aromatic nucleus such as phenyl, naphthyl or other aromatic derivatives further substituted by other groups such as linear or branched alkyls, cyclic alkyls, arylalkyls, heterarylalkyls or alkyls substituted with halogens or inert heteroatoms or a substituted oxygen atom directly bonded to the back phenyl ring. The examples of substituents on the oxygen atom are substituted or unsubstituted alkyl groups, such as alkyl containing 1 to 42, typically 1 to 22 carbon atoms, substituted aryl and heteroaryl groups, substituted acyl groups, substituted sulfonyl groups. Representative substituted alkyls include but are not limited to branched alkyls, cyclic alkyls, arylalkyls, heteroarylalkyls or alkyls substituted with halogens or inert heteroatoms.

Representative aryl groups include an aromatic nucleus such as phenyl, naphthyl or other aromatic derivatives further substituted by other groups such as linear or branched alkyls, cyclic alkyls, arylalkyls, heteroarylalkyls or alkyls substituted with halogens or inert heteroatoms.

If desired, the substituents may themselves be further substituted one or more times with the described substituent groups. The particular substituents used may be selected by those skilled in the art to attain the desired photographic properties for a specific application and can include, for example, hydrophobic group, solubilizing groups, blocking groups, releasing or releasable groups, etc. Generally, the above groups or substituents thereof may include those having up to 48 carbon atoms, typically 1 to 36 carbon atoms and usually less than 24 carbon atoms, but greater number are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The color photographic elements of the invention are multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one light-sensitive silver halide emulsion layer having associated therewith at least one cyan dye-forming coupler, a magenta dye image-forming unit comprising at least one light-sensitive silver halide emulsion layer having associated therewith at least one magenta dye-forming coupler, a yellow dye image-forming unit comprising at least one light-sensitive silver halide emulsion layer having associated therewith at least one yellow dye-forming coupler, and an 'blue' dye image-forming unit comprising at least one light-sensitive silver halide emulsion layer having associated therewith at least one 'blue' dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emswortb, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV.

Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color-developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, 'blue', cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022, 3,148,062; 3,227,554; 3,384,657; 3,379,529; 3,615,506; 3,617,291; 3,620,746; 3,701,783, 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018, 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch that produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulas:

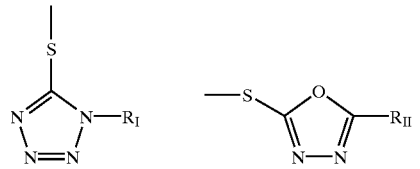

-continued

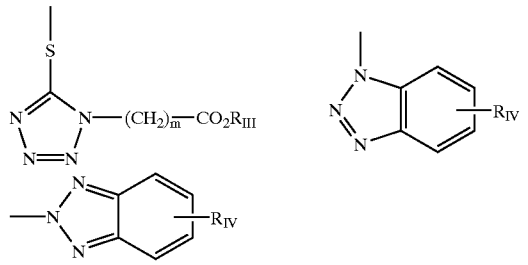

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —COORV and —$NHCOOR_V$ wherein $R_V$ is selected from substituted and unsubstituted alkyl and aryl groups.

It is contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Ser. No. 07/978,589 filed Nov. 19, 1992, and U.S. Ser. No. 07/978,568 filed Nov. 19, 1992, both granted, in conjunction with elements of the invention.

In addition, emulsions can be sensitized with mixtures of two or more sensitizing dyes, which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response.

In addition, emulsions of this invention may contain a mixture of spectral sensitizing dyes that are substantially different in their light absorptive properties. For example, Hahm, in U.S. Pat. No. 4,902,609, describes a method for broadening the effective exposure latitude of a color negative paper by adding a smaller amount of green spectral sensitizing dye to a silver halide emulsion having predominantly a red spectral sensitivity. Thus when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and hence a broader exposure latitude.

Waki et al. in U.S. Pat. No. 5,084,374, describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. It is preferred that the 3-dimensional grains be monodisperse and that the grain size coefficient of variation of the 3-dimensional grains is less than 35% or, most preferably less than 25%. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624, Maskasky U.S. Pat. No. 5,264,337, and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations ofthese basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 November/December 1980, pp. 265–267 (pm, Ir, a, b and d), Hochstetter U.S. Pat. No. 1,951,933 (Cu); De Witt U.S. Pat. No. 2,628,167 (T1, a, c), Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, bl); Habu et al U.S. Pat. No. 4,173,483 (VIII, bl); Atwell U.S. Pat. No. 4,269,927 (Cd, Pb, Cu, Zn, a2); Weyde U.S. Pat. No. 4,413,055 (Cu, Co, Ce, a2), Akimura et al U.S. Pat. No. 4,452,882 (Rh, i); Menjo et al U.S. Pat. No. 4,477,561 (pm, f); Habu et al U.S. Pat. No. 4,581,327 (Rh, cl, f); Kobuta et al U.S. Pat. No. 4,643,965 (VIII, Cd, Pb, f, c2), Yamashita et al U.S. Pat. No. 4,806,462 (pvmi, a2, g), Grzeskowiak et al U.S. Pat. No. 4,4,828,962 (Ru+Ir, b1); Janusonis U.S. Pat. No. 4,835,093 (Re, a1), Leubner et al U.S. Pat. No. 4,902,611 (Ir+4); Inoue et al U.S. Pat. No. 4,981,780 (Mn, Cu, Zn, Cd, Pb, Bi, In, Tl, Zr, La, Cr, Re, VIII, c1, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b), Asami U.S. Pat. Nos. 5,166,044 and 5,204,234 (Fe+kr, a2 b, c1, c3); Wu U.S. Pat. No. 5,166,045 (Se, a2); Yoshida et al U.S. Pat. No. 5,229,263 (Ir+Fe/Re/Ru/Os, a2, bl); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Tl, Fe, d); Miyoshi et al EPO 0 488 737 and 0 488 601 (ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, ol); Yamasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732, Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Ser. No. 08/091,148.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Ser. No. 08/091,148 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that adsorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective. Typical gold sensitizers are chloroaurates, aurous dithiosulfate, aqueous colloidal gold sulfide or gold (aurous bis(1,4,5-trimethyl-1,2,4-triazolium-3-thiolate)tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also useful.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following:

Research,Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak RA-4 color process as described in the British Journal of Photography Annual of 1988, pp 198–199. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing through an appropriate negative-working photographic process to give a positive color image. Color slides may be produced in a similar manner but are more typically produced by exposing the film directly in a camera and processing through a reversal color process or a direct positive process to give a positive color image. Alternative processes such as digital printing may also produce the image.

Each of these types of photographic elements has its own particular requirements for dye hue, but in general they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

Hereunder, the typical couplers relating to the present invention are presented. However the present invention shall not be limited thereto.

IC-1

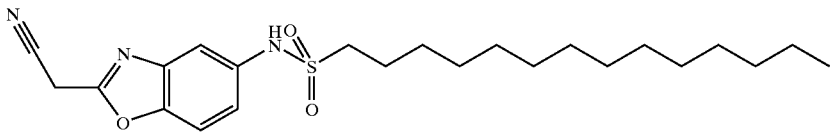

IC-2

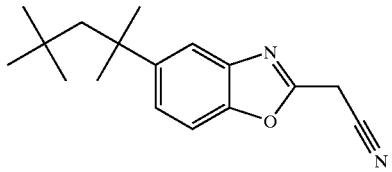

IC-3

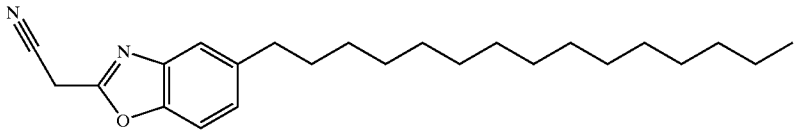

-continued
IC-4
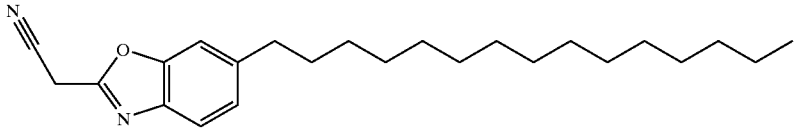
IC-5
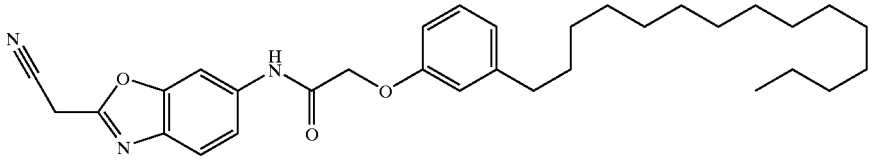
IC-6
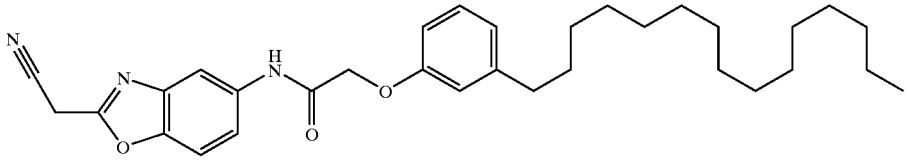
IC-7
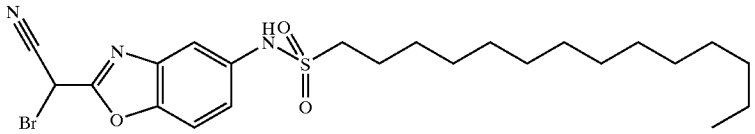
IC-8
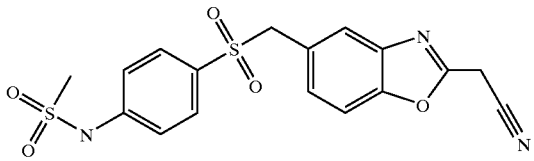
IC-9
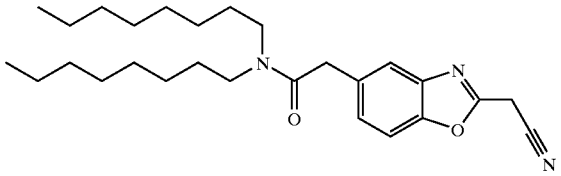
IC-10
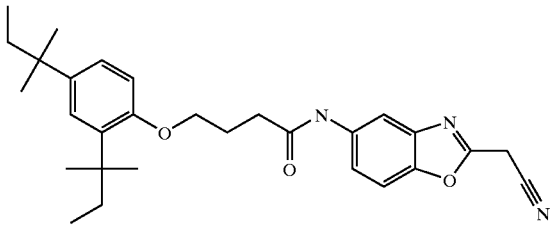
IC-11
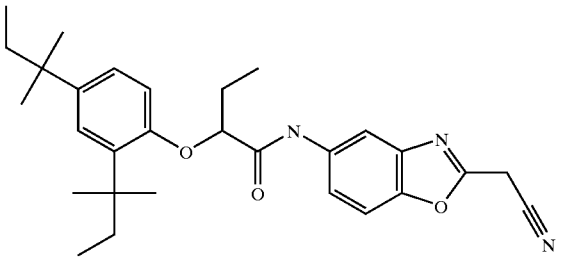
IC-12
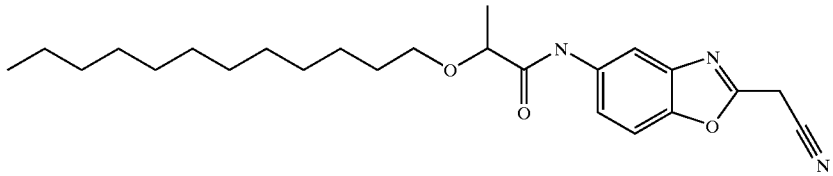
IC-13
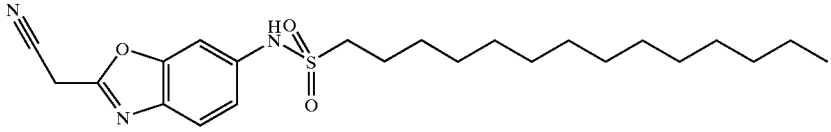

-continued
IC-14
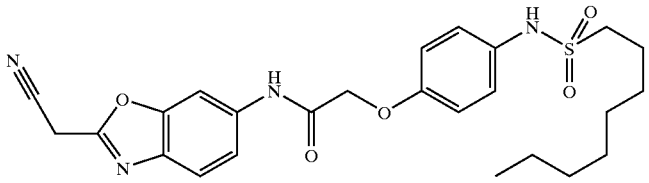
IC-15
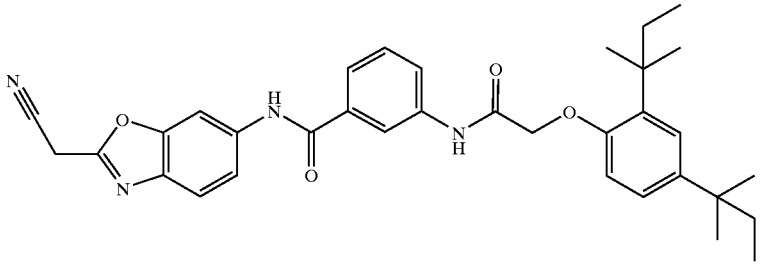
IC-16
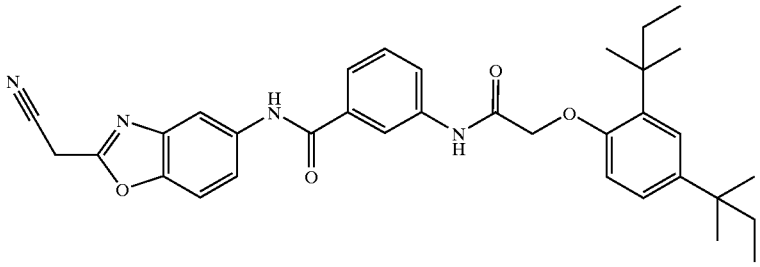
IC-17
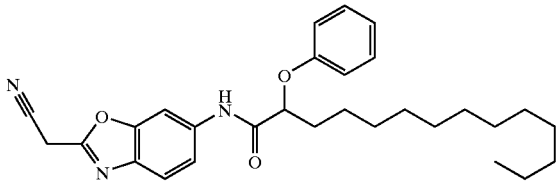
IC-18
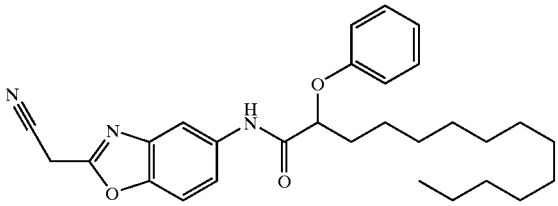
IC-19
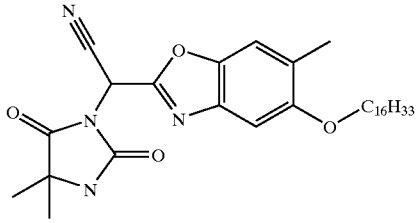
IC-20
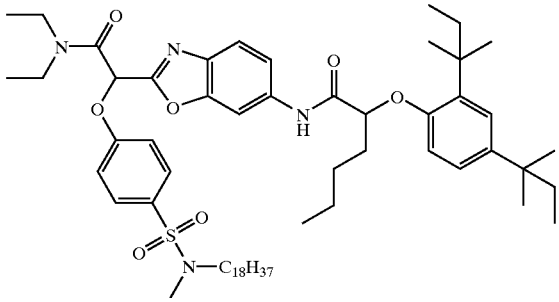
IC-21
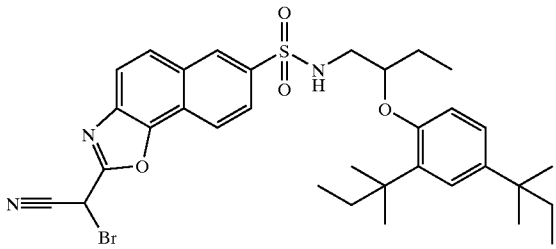
IC-22
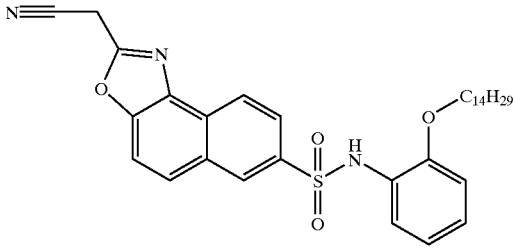

-continued
IC-23
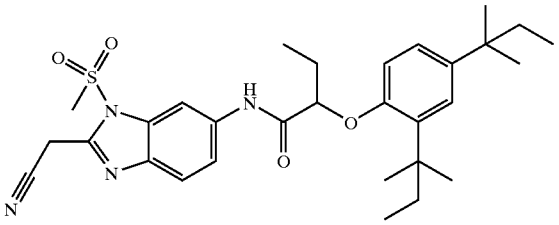
IC-24
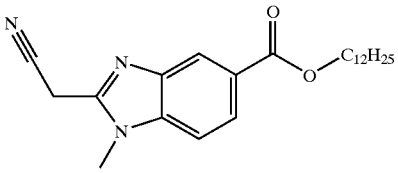
IC-25
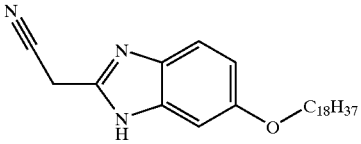
IC-26
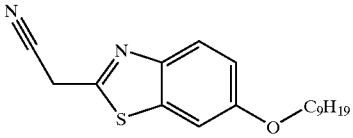
IC-27
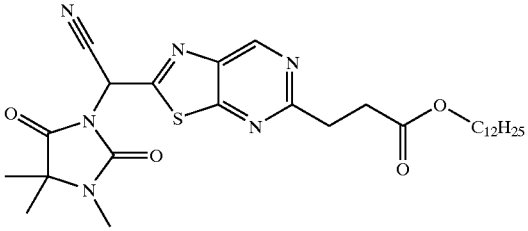
IC-28
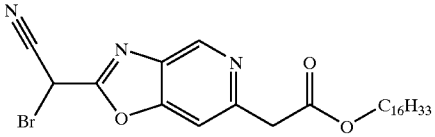
IC-29
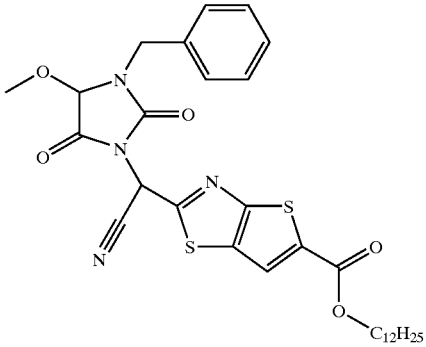
IC-30
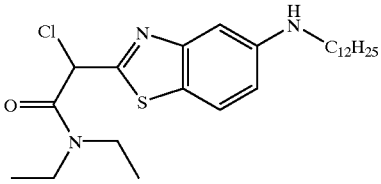
IC-31
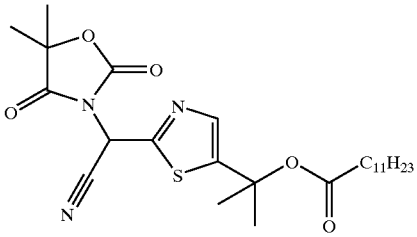
IC-32
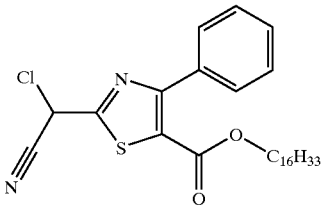
IC-33
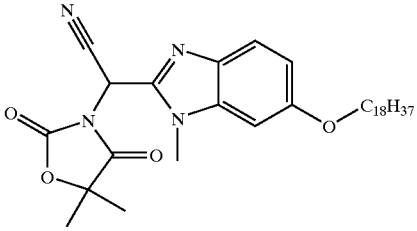
IC-34
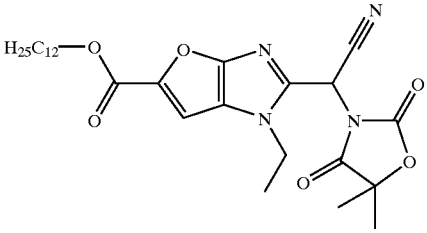

-continued

IC-35

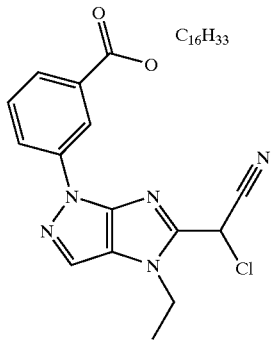

IC-36

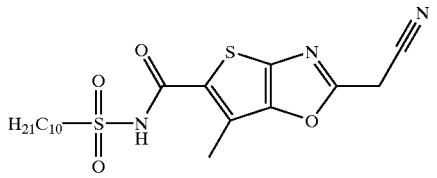

The couplers in the table were evaluated in a single layer photographic format using the paraphenylene diarnine D109B as the Color Developer. The densitometry of the developed strips was measured. The corresponding reflectance spectra were recorded and the corresponding Color Gamut increase was calculated.

The couplers useful in the invention allow the formation of "red" colorants which, in combination with cyan, magenta and yellow colorants produced in proportion to the amounts of exposure to four digitally controlled light sources, provide a reproduction that is pleasing to the observer and has improved capability to reproduce the so-called 'spot colors', Pantone colors or Hi-Fi colors.

EXAMPLE 1

Synthesis

Methyl Cyanoacetimidate Hydrochloride

Thionyl chloride (40.2 g, 0.34 mole) was added dropwise to a solution of malononitrile (41.96 g, 0.63 mole) in propyl acetate (200 ml) and methanol (40.7 g, 52 ml). The solution was cooled at 0° C. (internal temperature) using an ethanol-ice mixture and the addition was done at such a rate that the mixture temperature was kept below 10° C. After the addition, the mixture was kept below 20° C. for 1 h, and then stirred at 20° C. for 1 h. It was filtered and the solid was washed with propyl acetate (150 ml), dried under high vacuum overnight at room temperature and afforded methyl cyanoacetimidate hydrochloride (70.81 g, 83%).

4-Nitro-2-benzoxazoleacetonitrile

The mixture of methyl cyanoacetimidate hydrochloride (43.47 g, 0.32 mole) and 4-nitro-2-aminophenol (24.9 g, 0.16 mole) in methanol (260 ml) was heated at reflux for 3 h. The mixture was placed in an ice bath for 30 minutes and was filtered. The solid material was suspended in water (300

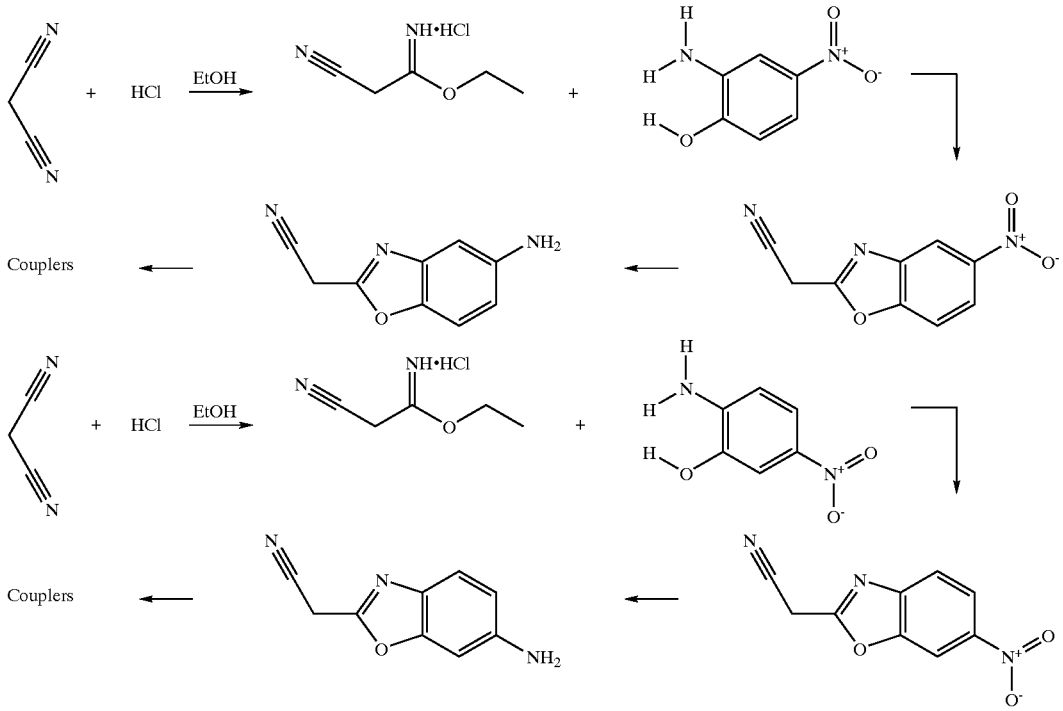

ml), stirred for a few minutes and filtered. It was washed with water (200 ml) and air dried to give 4-nitro-2-benzoxazoleacetonitrile (27.38 g, 83%).

4-Amino-2-benzoxazoleacetonitrile

The mixture of 4-nitro-2-benzoxazoleacetonitrile (27.22 g, 0.13 mole) and Palladium on carbon (3 g) in THF (320 ml) and acetic acid (5 ml) in a Parr bottle was hydrogenated at 50 psi for 15 h. It was filtered over a patch of celite (1.5 cm) covered with activated carbon (0.5 cm) and washed with isopropyl ether. The filtrate was evaporated and the residue was triturated with isopropyl ether and propyl acetate and filtered to give 4-amino-2-benzoxazoleacetonitrile (14.16 g, 61%).

5-Amino-2-benzoxazoleacetonitrile

The mixture of 5-nitro-2-benzoxazoleacetonitrile (8 g 39.4 mmole) and Palladium on carbon (1.2 g) in THF (100 ml) and acetic acid (2 ml) in a Parr bottle was hydrogenated at 50 psi for 5 h. It was filtered over a patch of celite (1.5 cm) covered with activated carbon (0.5 cm) and washed with isopropyl ether. The filtrate was evaporated and the residue was purified by flash chromatography and gave 5-amino-2-benzoxazoleacetonitrile (2.02 g, 30%).

Coupler Synthesis by Acylation

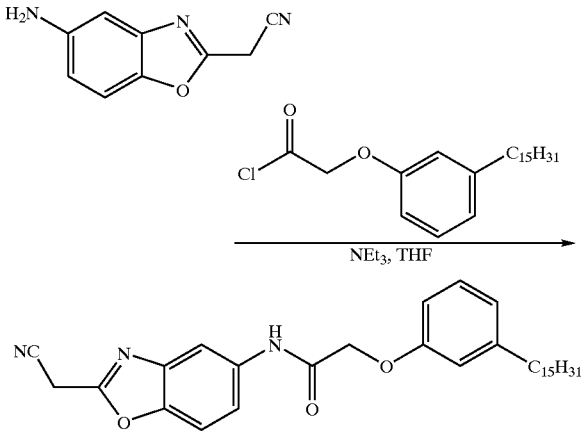

A solution of the acid chloride (5.3 mmole) in THF (10 ml) was added to a solution of 4-amino-2-benzoxazoleacetonitrile (4.4 mmole) and triethylamine (6.66 mmole) in THF (10 ml). The mixture was stirred at room temperature for 16 h, diluted with ethyl acetate (120 ml) and washed with water (100 ml). The two phases were separated and the aqueous phase was extracted with ethyl acetate (2×50 ml). The combined organic phase was dried over $MgSO_4$, filtered and evaporated. The residue was purified by flash chromatography to give the invention coupler IC-6.

Coupler Synthesis by Sulfonylation

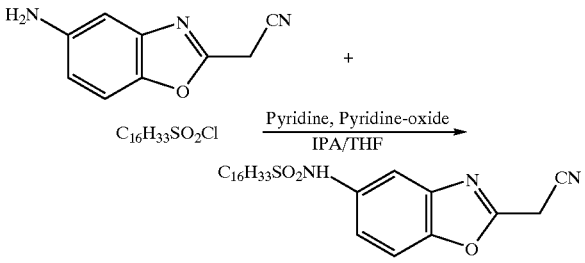

To a solution of 4-amino-2-benzoxazoleacetonitrile (3.4 g, 19.6 mmole) in isopropanol (50 ml) and THF (20 ml) was added pyridine (2.02 g, 25.5 mmole) and pyridine N-oxide (0.05 g, 0.5 mmole) followed by hexadecanesulfonyl chloride (7.02 g, 21.6 mmole). The mixture was stirred at room temperature for 3 h. It was diluted with propyl acetate (200 ml) and successively washed with dilute HCl (0.2N, 2×200 ml) and brine (200 ml). The organic phase was dried over $MgSO_4$ and activated carbon, filtered and evaporated to give the invention coupler IC-1 (8 g, 88%).

EXAMPLE 2

Synthesis

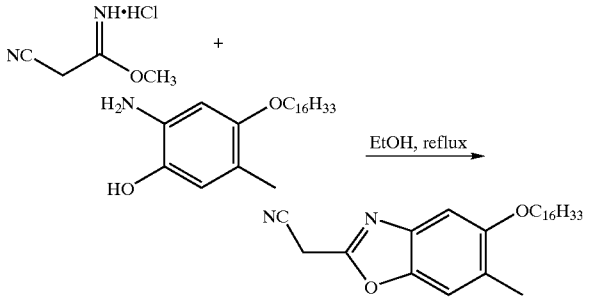

The mixture of methyl cyanoacetimidate hydrochloride (4.13 g, 30.8 mmole) and the 2-amino-5-methyl-4-hexadecyloxyphenol (6.15 g, 15.4 mmole) in ethanol (100 ml) was heated at reflux for 20 h. After cooling to room temperature, the mixture was filtered. The solid material was suspended in water (200 ml), stirred for 10 minutes and filtered. The solid was air-dried and gave the invention coupler IC-19 (5.77 g, 91%).

EXAMPLE 3

Synthesis

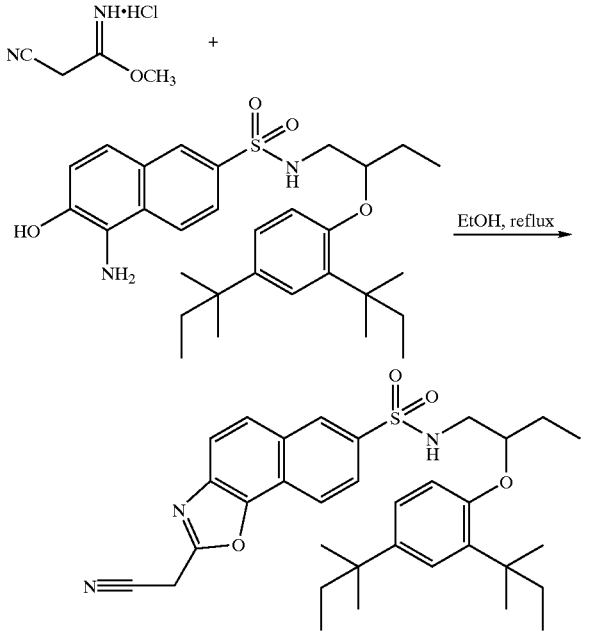

The mixture of methyl cyanoacetimidate hydrochloride (3.06 g, 22.8 mmole) and the aminonaphtol (6 g, 11.4 mmole) in ethanol (30 ml) was heated at reflux for 22 h. After cooling to room temperature, the mixture was evaporated. The residue was triturated with isopropyl ether and filtered. The filtrate was evaporated; the residue was purified by flash chromatography (Ethyl acetate/P950 ligroin: 3/7) and gave the invention coupler IC-21 (5 g, 76%).

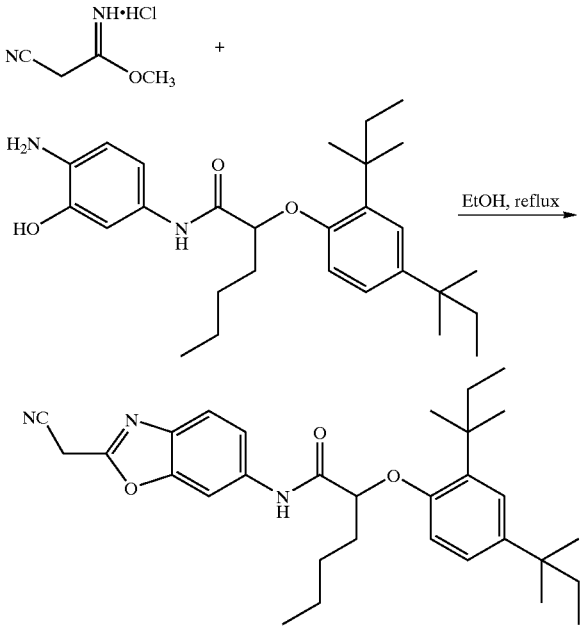

The mixture of methyl cyanoacetimidate hydrochloride (6.51 g, 48.4 mmole) and the aminophenol (10 g, 22 mmole) in ethanol (150 ml) was heated at reflux for 20 h. After cooling to room temperature, the mixture was evaporated. The residue was purified by flash chromatography (Ethyl acetate/P950 ligroin: 3/7) and gave the invention coupler IC-20 (10.98 g, 99%).

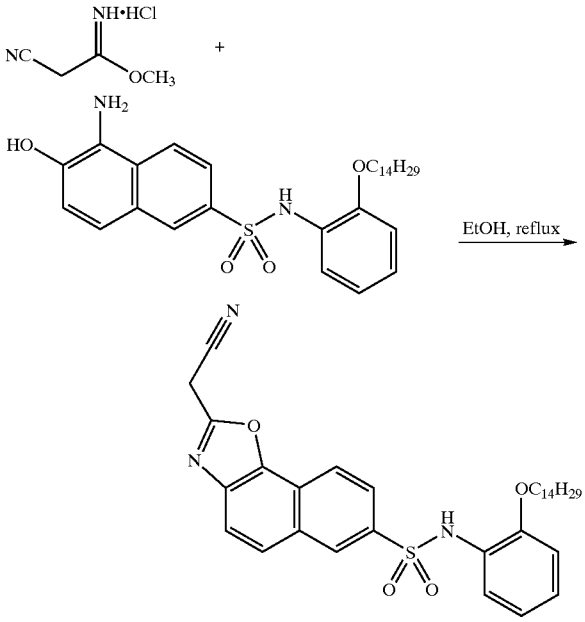

The mixture of methyl cyanoacetimidate hydrochloride (3.58 g, 26.6 mmole) and the aminonaphtol (6 g, 11.4 mmole) in ethanol (100 ml) was heated at reflux for 3 days. After cooling to room temperature, the mixture was evaporated. The residue was purified by flash chromatography (Ethyl acetate/P950 ligroin: 3/7) and gave the invention coupler IC-22 (2.5 g, 33%).

Photographic Examples

The following example illustrates the practice of the present invention in a silver halide photographic element and the advantage in maximum dye density generated ($D_{max}$) and speed of the resultant "Red" image dyes resulting in the elements of the invention compared with the comparison elements using comparison couplers shown below. (Table I)

CC1

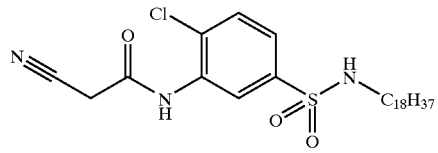

CC2

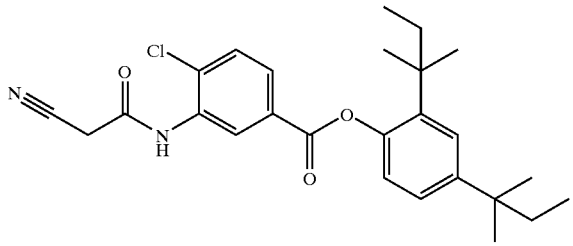

EXAMPLE 4

Single Layer Coating Containing a Red Sensitized Emulsion

A silver chloride emulsion was chemically and spectrally sensitized as is described below.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length. In addition, ruthenium hexacyanide dopant (at 16.5 mg/Ag-M) and $K_2IrCl_5$ (5-methylthiazole) dopant (at 0.99 mg/Ag-M) were added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant, $K_2IrCl_6$ (149 $\mu$g/Ag-M), potassium bromide, (0.5 Ag-M%), and red sensitizing dye RSD-1 (7.1 mg/Ag-M).

RSD-1

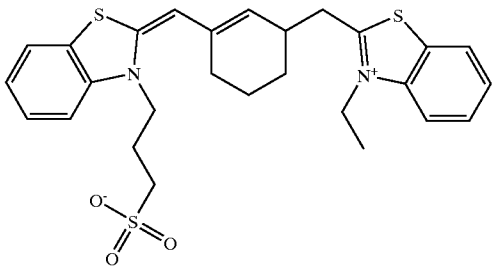

Dispersions of example couplers, were emulsified by methods well known to the art, and were coated on the face side of a doubly extruded polyethylene coated color paper support using conventional coating techniques. The gelatin layers were hardened with bis (vinylsulfonyl methyl) ether at 2.4% of the total gelatin. The emulsion described above was evaluated in a single emulsion layer-coating format using conventional coating preparation methods and techniques. This coating format is described below in detail:

TABLE 1

Single Layer Coating Format

| Layer | Coating Material | Coverage mg/M$^2$ |
|---|---|---|
| Overcoat | Gelatin | 1064. |
| | Gel hardener | 105. |
| Imaging | Emulsion Red EM-1 | Varies between 75.3 and 322.8 |
| | Couplers as indicated | Varies between 237 to 323 |
| | Gelatin | 1658. |
| Adhesion sub-layer | Gelatin | 3192. |
| Polyethylene coated paper support | | |

Once the coated paper samples described above had been prepared, they were given a preliminary evaluation as follows:

The respective paper samples were exposed in a Kodak Model 1B sensitometer with a color temperature of 3000° K and filtered with a Kodak Wratten™ 2C plus a Kodak Wratten™ 29 filter and a Hoya HA-50. Exposure time was adjusted to 0.1 seconds. The exposures were performed by contacting the paper samples with a neutral density step exposure tablet having an exposure range of 0 to 3 log-E.

The paper samples described above as coating examples 1 to 17 were processed in the Kodak Ektacolor RA-4 Color Development™ process. The color developer and bleach-fix formulations are described below in Tables 2 and 3. The chemical development process cycle is described in Table 4.

TABLE 2

Kodak Ektacolor ™ RA-4 Color Developer

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 ™ (1-Hydroxyethyl-1,1- | 1.16 |

TABLE 2-continued

Kodak Ektacolor ™ RA-4 Color Developer

| Chemical | Grams/Liter |
|---|---|
| diphosphonic acid (60%) | |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/− 0.05

TABLE 3

Kodak Ektacolor ™ RA-4 Bleach-Fix

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |

pH @ 26.7° C. is 5.5 +/− 0.10

TABLE 4

Kodak Ektacolor ™ RA-4 Color Paper Process

| Process Step | Time (seconds) |
|---|---|
| Color Development | 45 |
| Bleach-fix | 45 |
| Wash | 90 |
| Dry | |

Processing the exposed paper samples is performed with the developer and bleach-fix temperatures adjusted to 35° C. Washing is performed with tap water at 32.2° C.

To facilitate comparisons, the characteristic vector, also determined from principle component analysis was determined using standard characterization methods since the absorption characteristics of a given colorant will vary to some extent with a change in colorant amount. This is due to factors such as measurement flare, colorant—colorant interaction, colorant-support interactions, colorant concentration effects and the presence of color impurities in the media. However, by using characteristic vector analysis, one can determine a characteristic absorption curve that is representative of the absorption characteristics of the colorant over the complete wavelength and density ranges of interest. This technique is described by J. L. Simonds in the Journal of the Optical Society of America, 53(8), 968–974, 1963.

The spectral absorption curve of each dye was measured using a MacBeth Model 2145 Reflection Spectrophotometer having a Xenon pulsed source and a 10 nm nominal aperture. Reflection measurements were made over the wavelength range of 380–750 nanometers using a measurement geometry of 45/0, and the characteristic vector (transmission density-vs.-wavelength) for each coupler specimen was calculated. The color gamut's resulting from using the characteristic vectors to calculate the gamut using the methods as described in J. Photographic Science, 38, 163 (1990) were determined and the results are given in Table III. Color gamuts are obtained by the above calculation method, assuming the use of resin-coated photographic paper base material, no light scatter, a D5000 viewing illuminant, and a Dmax of 2.2. The optimal spectral regions hold true for any Dmin, any amount of flare, any Dmax and any viewing illuminant.

The λ-max (normalized to 1.0 density) of the characteristic vector of each dye, the $D_{max}$, the speed and the resulting Color Gamut is summarized in Table 5 below:

TABLE 5

| Element | Coupler | $\lambda_{max}$ | $D_{max}$ | Speed | Gamut |
|---|---|---|---|---|---|
| | | Results | | | |
| Element-1 | CC-1 | 510 | 1.39 | 120 | 62,950 |
| Element-2 | CC-2 | 507 | 1.16 | 98 | 63,181 |
| Element-3 | IC-1 | 520 | 1.99 | 148.6 | 63,567 |
| Element-4 | IC-2 | 514 | 1.72 | 144.6 | 63,704 |
| Element-5 | IC-3 | 516 | 1.91 | 144.6 | 63,891 |

The maximum dye density values, the film speed as well as the color gamut results in Table 5 clearly show that the photographic element of the invention tested produce more "red" dye, faster than the comparison couplers. The data in the table also shows that the invention couplers tested lead to a photographic product with a broader color gamut than the comparison couplers.

What is claimed is:

1. A photographic element comprising a support bearing a light sensitive silver halide emulsion layer having associated therewith a dye forming coupler having a formula I,

I

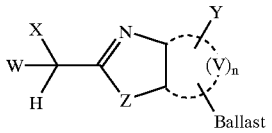

wherein:

Ballast is a group containing at least 6 aliphatic carbon atoms,

V represents a chain of three or four atoms, which may be substituted, selected from C, N, O and S sufficient to form an aromatic ring fused to the azole ring and n is 0 or 1, provided that if n is 0, Y and Ballast are directly attached to the 5-membered azole ring, W is an electron withdrawing group selected from the group consisting of —CN, —$CONR_1R_2$, —$CO_2R_1$, —$NO_2$, and —$SO_2R_1$ where $R_1$ and $R_2$ are H or substituents;

X is H or a coupling-off group;

Y is H or a substituent;

Z is an atom or group selected from >N—R, —O—, and —S—.

2. The element of claim 1 wherein Ballast is selected from the group consisting of alkyl or aryl groups containing at least 6 carbon atoms and directly bonded to the aromatic back ring or through a heteroatom.

3. The element of claim 1 wherein n is 1 and V represents a chain of 4 atoms.

4. The element of claim 1 wherein W is a cyano group.

5. The element of claim 4 wherein X is H, or a coupling off group selected from the group consisting of halogen, hydantoin and phenoxy groups.

6. The element of claim 1 wherein Y is H or an alkyl or aryl group.

7. The element of claim 1 wherein the dye-forming coupler is represented by formula II,

II

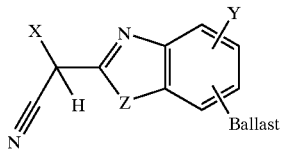

wherein:

X, Y, Z, and Ballast are as defined in claim 1.

8. The element of claim 7 wherein the ballast is selected from alkyl or aryl groups of at least 6 carbon atoms bonded to the phenyl ring through a carbon or a heteroatom.

9. The element of claim 1 where the substituent groups are selected so that the hue angle of the dye formed by the reaction of the coupler with oxidized developer is not less than 355 and not more than 75°.

10. A photographic element comprising a red sensitive first silver halide emulsion layer having associated therewith a cyan dye image forming coupler, a green sensitive second silver halide emulsion layer having associated therewith a magenta dye image forming coupler, a blue sensitive third silver halide emulsion layer having associated therewith a yellow dye image forming coupler, and a light sensitive fourth silver halide emulsion layer as described in claim 1 that is sensitive to light having maximum absorption at least 25 nm different from the absorption maxima for the red, green and blue sensitive layers.

11. The element of claim 1 wherein the fourth silver halide emulsion layer is located farther from the support than all of the other light sensitive layers.

12. The element of claim 1 wherein the fourth silver halide emulsion layer is located closer to the support than all of the other light sensitive layers.

13. The element of claim 1 wherein there is a non-light sensitive layer between the fourth silver halide emulsion layer and any other light sensitive layer.

14. The element of claim 1 wherein the dye forming coupler is selected from the following:

IC-1

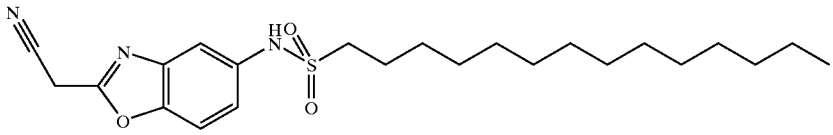

-continued
IC-2
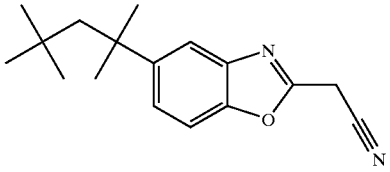
IC-3
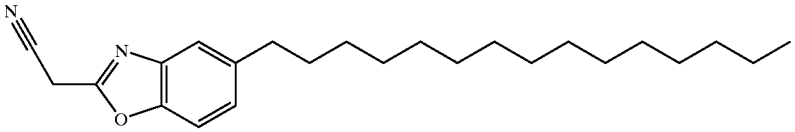
IC-4
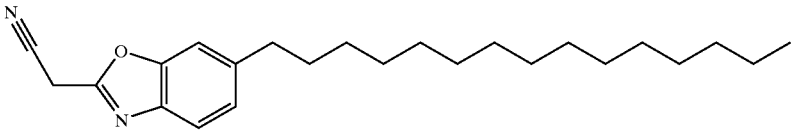
IC-5
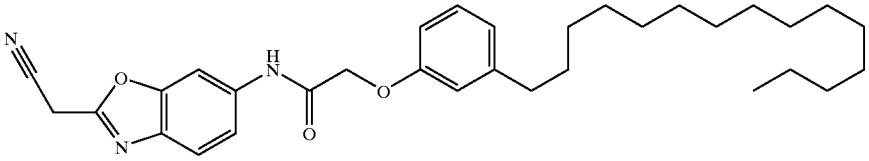
IC-6
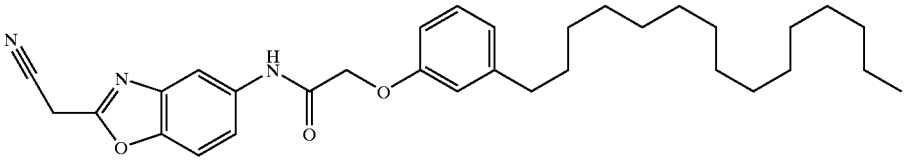
IC-7
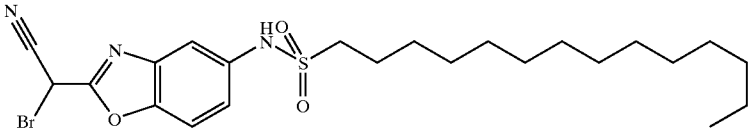
IC-8
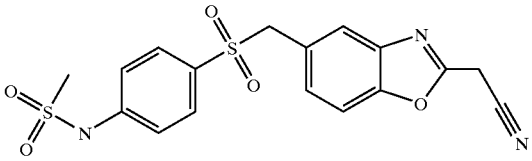
IC-9
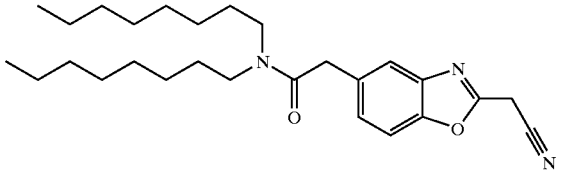
IC-10
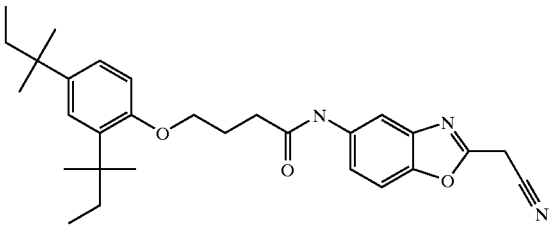
IC-11
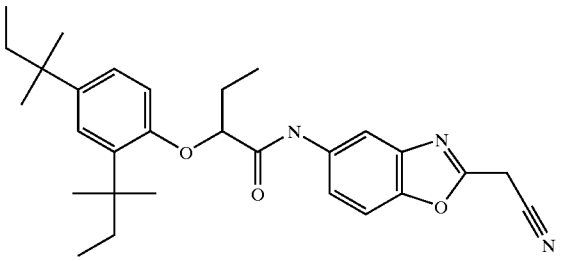
IC-12
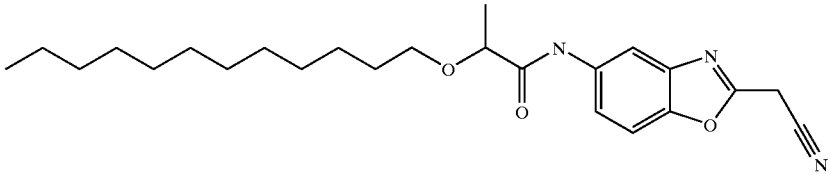

-continued
IC-13
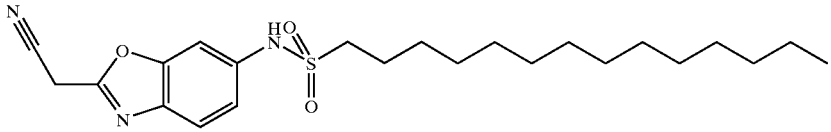
IC-14
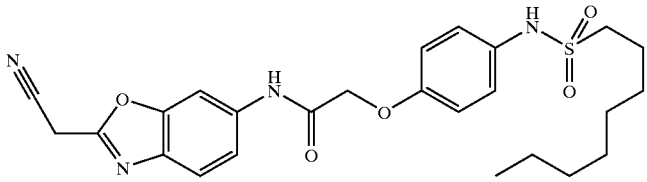
IC-15
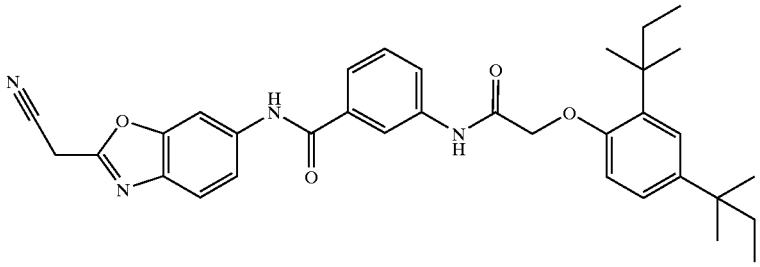
IC-16
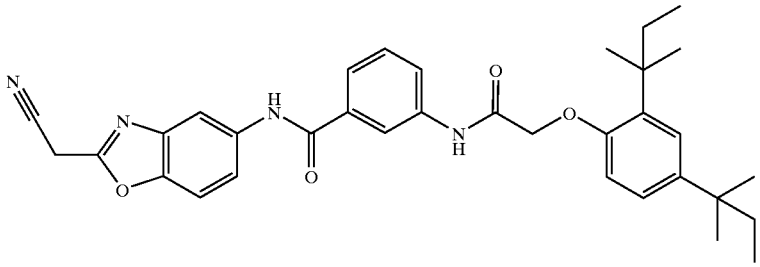
IC-17
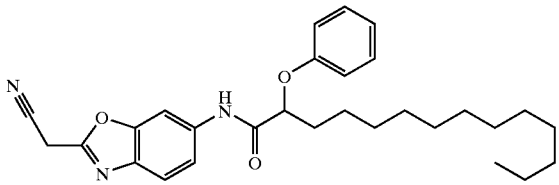
IC-18
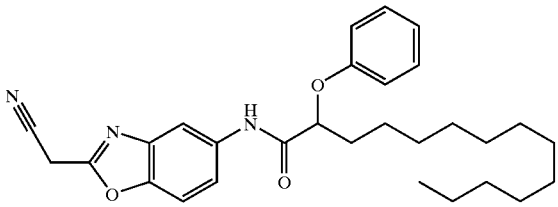
IC-19
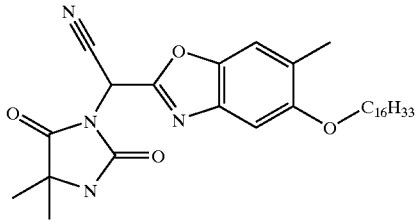
IC-20
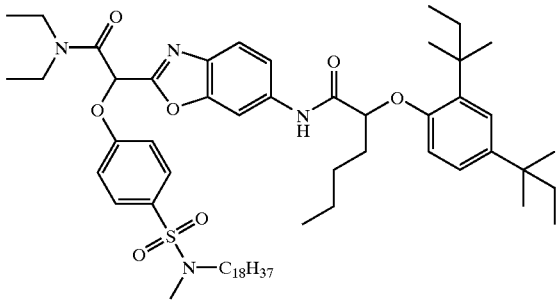

-continued
IC-21
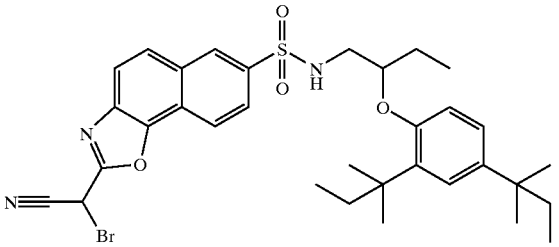
IC-22
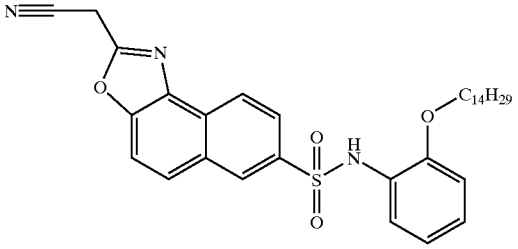
IC-23
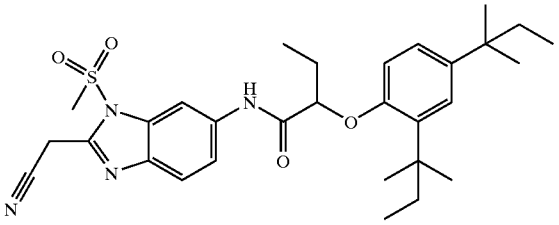
IC-24
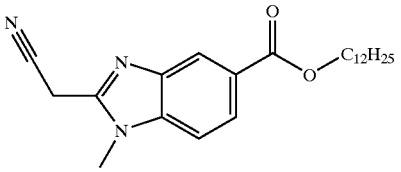
IC-25
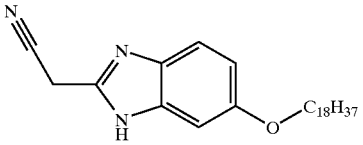
IC-26
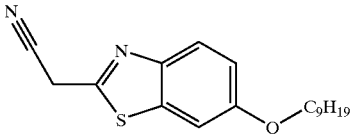
IC-27
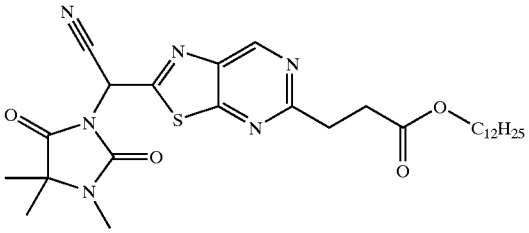
IC-28
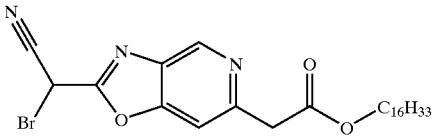
IC-29
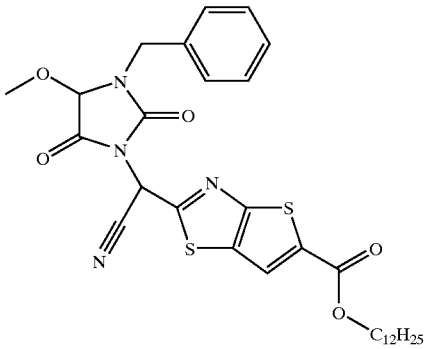
IC-30
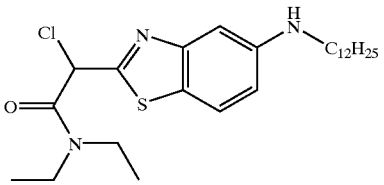
IC-31
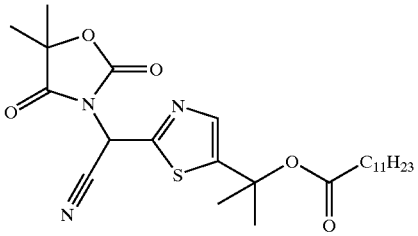
IC-32
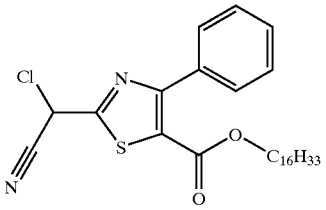

-continued
IC-33
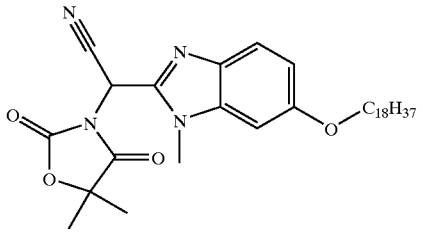
IC-34
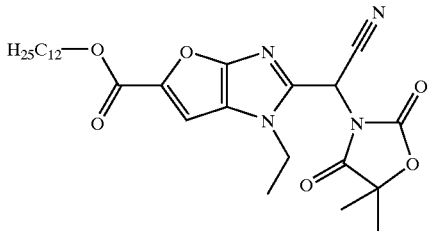
IC-35
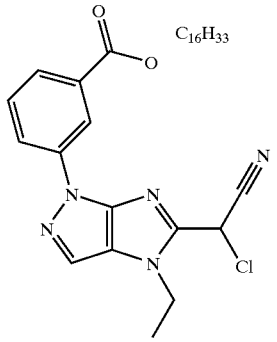
IC-36
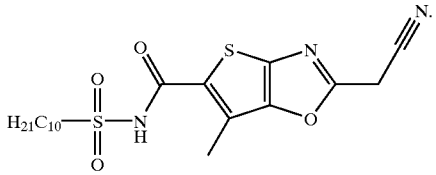
15. The element of claim 1 wherein the dye forming coupler is selected from the following:
IC-1
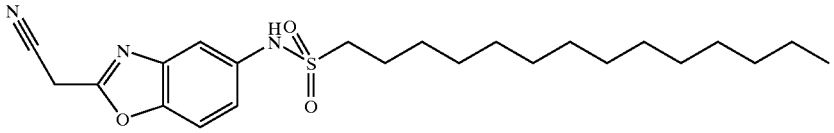
IC-2
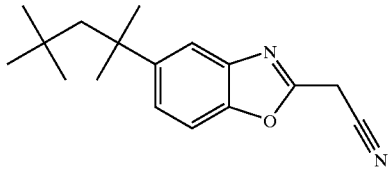
IC-3
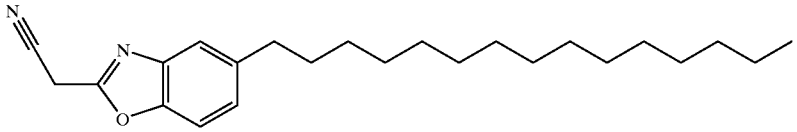
* * * * *